US009266365B1

(12) United States Patent
Murata et al.

(10) Patent No.: US 9,266,365 B1
(45) Date of Patent: Feb. 23, 2016

(54) PRINTER

(71) Applicant: Brother Kogyo Kabushiki Kaisha, Nagoya-shi, Aichi-ken (JP)

(72) Inventors: Susumu Murata, Konan (JP); Yasuhiro Torii, Chiryu (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/851,049

(22) Filed: Sep. 11, 2015

(30) Foreign Application Priority Data

Dec. 22, 2014 (JP) ..... 2014-259331

(51) Int. Cl.
*B41J 11/00* (2006.01)
*B41J 3/60* (2006.01)
*B41J 11/66* (2006.01)

(52) U.S. Cl.
CPC ..... *B41J 11/663* (2013.01)

(58) Field of Classification Search
CPC ..... B41J 11/663; B41J 3/60; B41J 11/007; B41J 11/0095
See application file for complete search history.

(56) References Cited

U.S. PATENT DOCUMENTS 8,866,864 B2 * 10/2014 Otsuka ..... B41J 2/32 347/220
8,939,666 B2 * 1/2015 Tamai ..... B65H 23/1882 347/104

FOREIGN PATENT DOCUMENTS

JP H07-101119 A 4/1995

* cited by examiner

*Primary Examiner* — Thinh Nguyen
(74) *Attorney, Agent, or Firm* — Banner & Witcoff, Ltd.

(57) ABSTRACT

A printer includes a feeding portion, a guide portion, and a processor. The processor determines whether a roll sheet in the printer is an inward facing roll sheet or an outward facing roll sheet. When the roll sheet is the inward facing roll sheet, the processor controls the feeding portion to move the downstream-side end portion of the print medium from the cutting position to an upstream side in the feed direction than the upstream end portion before the printing. And the processor controls the printing portion to start printing. When the roll sheet is the outward facing roll sheet, the processor controls the printing portion to start printing in a state in which a downstream-side end portion of the print medium in the feed direction is positioned further to a downstream side in the feed direction than an upstream-side end portion of the guide portion in the feed direction.

8 Claims, 10 Drawing Sheets

PRINTER

CROSS-REFERENCE TO RELATED APPLICATION

This application claims priority to Japanese Patent Application No. 2014-259331 filed Dec. 22, 2014, the content of which is hereby incorporated herein by reference.

BACKGROUND

The present disclosure relates to a printer that prints on a long sheet-shaped print medium.

A printer is known that is capable of printing on a long sheet-shaped print medium to which a release paper is adhered using an adhesive applied on a back surface of the print medium. The printer holds a roll sheet, which is wound with a print surface of the print medium facing an inner peripheral side, in a holder, and removably houses the roll sheet inside a housing. The printer causes a platen roller to be driven so as to pull out the print medium from the holder and feed the print medium, and prints characters, graphics, etc. on the print medium using a thermal head. The printed print medium is cut into a desired length by a cutting mechanism. The cutting mechanism is disposed further to the downstream side than the thermal head in a feed direction. The cut printed print medium is discharged to the outside from a discharge outlet.

A printer is known in which after the discharge of the printed print medium is complete, the printer is caused to stand by while a leading end portion of the print medium is disposed on a feed guide of the cutting mechanism. At the time of the next printing, a print start position of the print medium is moved back to a position of the thermal head, and then, printing is performed.

Meanwhile, when the above-described roll sheet is used that is wound with the print surface facing the inner peripheral side, the printed print medium retains an effect generated when it has been wound and held, which tends to cause the print surface to warp inward. Thus, when a print medium using a relatively weak adhesive is used, as time elapses, there is a possibility that an edge portion of the print medium may curl up on an adhering surface. In this case, by using a roll sheet that is wound with the print surface facing an outer peripheral side, it is possible to inhibit the edge portion of the print medium from curling up on the adhering surface due to the tendency of the print surface of the print medium to warp outward.

SUMMARY

However, if the roll sheet that is wound with the print surface facing the outer peripheral side is used in the printer, when the print medium whose leading end portion is warped upward is moved back in the above-described manner, and the printing is performed on the print medium, there is a possibility that the leading end portion may enter into a gap between the thermal head and the feed guide, and sheet jamming may occur.

Various embodiments of the broad principles derived herein provide a printer that are capable of causing a print medium to be moved back when printing is performed on a roll sheet that is wound with a print surface of the print medium facing an inner peripheral side, and of inhibiting the print medium from being moved back when the printing is performed on a roll sheet that is wound with the print surface of the print medium facing an outer peripheral side.

Exemplary embodiments provide a printer that includes a storage portion, a feeding portion, a printing portion, a cutting portion, a guide portion, a processor, and a memory. The storage portion is configured to store a roll sheet as a print medium. The print medium is a long sheet-shaped medium. A release paper is adhered to a back surface of the print medium by an adhesive. The back surface is an opposite side of a print surface. The feeding portion is configured to feed the print medium pulled out from the storage portion along a longitudinal direction of the print medium. The printing portion is configured to perform printing on the print surface of the print medium fed by the feeding portion. The cutting portion is provided separately from the printing portion and further to a downstream side in a feed direction of the print medium than the printing portion, and configured to cut the print medium printed by the printing portion. The guide portion is provided between the printing portion and a cutting position of the cutting portion and separately from the printing portion. The guide portion is configured to guide the print medium fed by the feeding portion to the cutting position. The memory is configured to store computer-readable instructions that, when executed by the processor, cause the printer. The processor is configured to determine whether the roll sheet stored in the storage portion is an inward facing roll sheet or an outward facing roll sheet. The inward facing roll sheet is a sheet that is wound with the print surface facing an inner peripheral side. The outward facing roll sheet is a sheet that is wound with the print surface facing an outer peripheral side. In a case where it is determined that the roll sheet is the inward facing roll sheet, before the printing on the print medium is performed by the printing portion, the processor controls the feeding portion so as to cause a print medium leading end portion to be moved from the cutting position and to be positioned further to an upstream side in the feed direction than an upstream end portion. The processor also controls the printing portion so as to cause the printing on the print medium to be started after the controlling of the feeding portion is completed. The print medium leading end portion is a downstream-side end portion of the print medium in the feed direction. The upstream end portion is an upstream-side end portion of the guide portion in the feed direction. In a case where it is determined that the roll sheet is the outward facing roll sheet, the processor controls the feeding portion and the printing portion so as to cause the printing on the print medium to be started in a state in which the print medium leading end portion is positioned further to the downstream side in the feed direction than the upstream end portion.

BRIEF DESCRIPTION OF THE DRAWINGS

Embodiments will be described below in detail with reference to the accompanying drawings in which.

DETAILED DESCRIPTION

Figure 1:
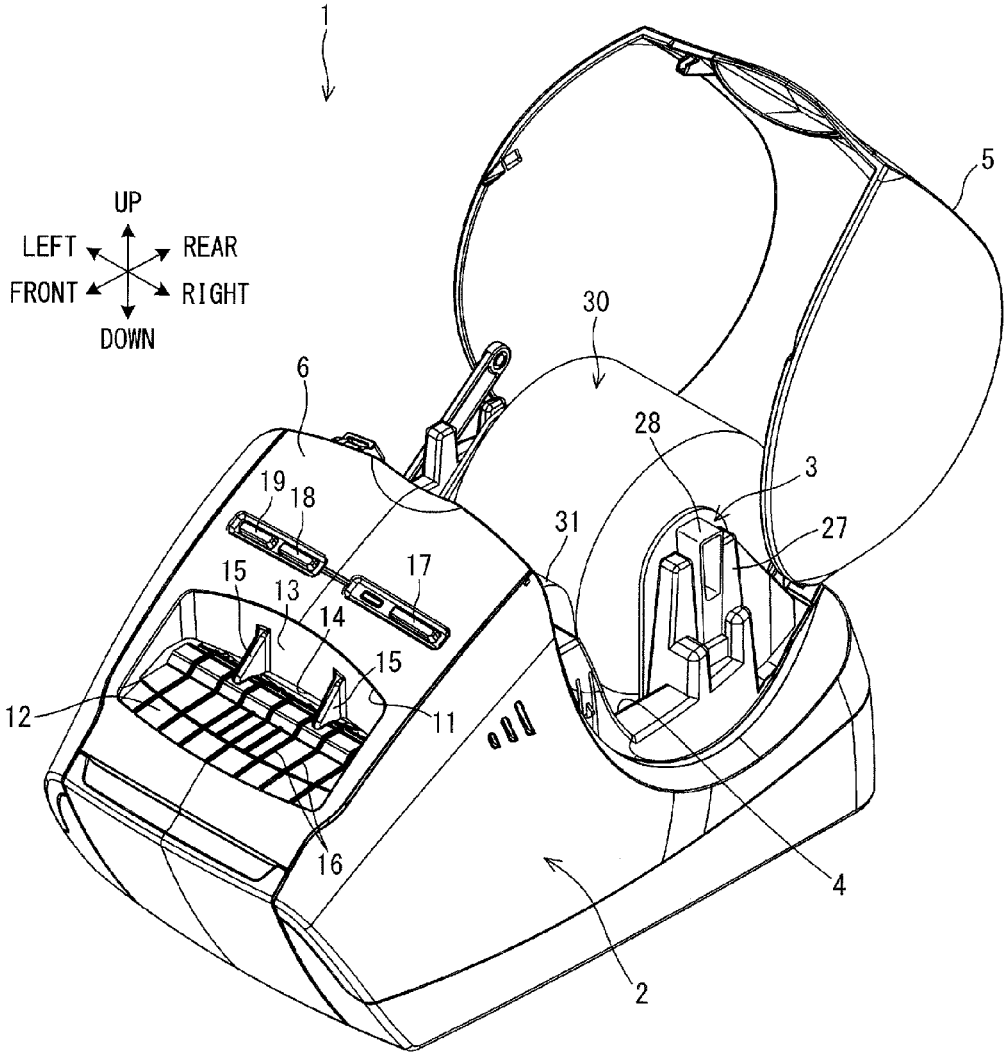
FIG. 1 is a perspective view of a printer 1 as viewed from the front and the upper right side.

Hereinafter, an embodiment of the present disclosure will be explained with reference to the drawings. Note that the drawings referred to are used to explain technological features that can be adopted by the present disclosure. Configurations of devices noted in the drawings are not limited only to the examples given and are simply explanatory examples.

An outline configuration of a printer 1 according to the present disclosure will be described with reference to FIG. 1 to FIG. 3. In the description below, a lower left side, an upper right side, an upper left side, a lower right side, an upper side, and a lower side in FIG. 1 are respectively defined as a front side, a rear side, a left side, a right side, an upper side, and a lower side of the printer 1.

The printer 1 shown in FIG. 1 is a device that prints various characters (letters, numerals, symbols, and graphics, etc.) on a long label sheet (hereafter simply referred to as a "sheet") 31. The printer 1 is provided with a resin housing 2. A storage portion 4 is provided on the inside and to the rear of the housing 2. The storage portion 4 is a portion inside the housing 2 in which a holder 3 is fitted. The holder 3 holds a roll sheet 30. The storage portion 4 is provided with a support member 27, which stands upward from a bottom surface of the storage portion 4, and an upper portion of which is forked in two. The holder 3 is supported and positioned inside the storage portion 4 as a result of a protruding portion 28, which protrudes rightward, engaging with the forked portion of the support member 27.

A heat-sensitive sheet, a printing tape, a label sheet, and the like may be used as the sheet 31. The heat-sensitive sheet is a so-called thermal paper, and is a long print medium that has self-color development characteristics in response to heat. The printing tape is a print medium that is formed by laminating a release paper on one side of the long heat-sensitive sheet using an adhesive. The label sheet is a print medium that is formed by cutting the heat-sensitive sheet into a plate-like shape having a predetermined size and causing labels, on one side of which an adhesive is applied, to be adhered to a long release paper so that the labels are arranged side by side at predetermined intervals on the release paper. In the present embodiment, the above-described printing tape will be used as one example of the sheet 31 having a predetermined width.

A concave portion (not shown in the drawings), with which a bottom portion of the holder 3 engages, is formed in the bottom surface of the storage portion 4. A sheet identification sensor 51 (refer to FIG. 4) is provided inside the concave portion. The sheet identification sensor 51 is a plurality of switches configured by plungers and micro switches. A sheet identifier (not shown in the drawings) is provided in the bottom portion of the holder 3. The sheet identifier is configured by a plurality of sensor holes that are open on the bottom portion of the holder 3. Each of the sensor holes is formed at a position corresponding to each of the switches of the sheet identification sensor 51, while being arranged in a combination according to a type of the sheet 31. When the holder 3 is stored in the storage portion 4, an OFF state is maintained for the switch corresponding to the position at which the sensor hole is formed. Further, the switch corresponding to the position at which the sensor hole is not formed is turned to an ON state. Therefore, a CPU 41 (refer to FIG. 4) of the printer 1 can obtain information of the sheet 31 held by the holder 3 based on the combination of ON/OFF signals obtained from the sheet identification sensor 51.

The information of the sheet 31 includes a type and a size of the sheet 31, a winding orientation of the roll sheet 30, etc. The type information of the sheet 31 is information of the heat-sensitive sheet, the printing tape, the label sheet, etc. The size information of the sheet 31 is a tape width. Further, in the case of the label sheet, the size information includes information regarding a size of one label (a length in the feed direction, and a width). The winding orientation information of the roll sheet 30 indicates whether the roll sheet is an inward facing roll sheet or an outward facing roll sheet. The inward facing roll sheet is a roll sheet that is wound with a print surface of the print medium facing an inner peripheral side of the roll sheet. The outward facing roll sheet is a roll sheet that is wound with the print surface of the print medium facing an outer peripheral side of the roll sheet. In a print control program that will be described later, the CPU 41 controls feeding of the sheet 31 in accordance with the winding orientation of the roll sheet 30, based on the information of the sheet 31 obtained from the sheet identification sensor 51.

An upper cover 5 is attached to a rear-side upper edge portion of the housing 2 so as to be able to be freely opened and closed. The upper cover 5 is formed of transparent or semi-transparent resin and is a substantially semicircular lid body in a side view. When the upper cover 5 is closed, the upper cover 5 covers the storage portion 4.

A resin front cover 6 that covers a front side of the housing 2 is provided on a front side of the upper cover 5. A concave portion 11 that opens in a substantially rectangular shape in a front view is formed in a center of the front cover 6. A discharge outlet 14 is provided to the rear of the center of the concave portion 11 in a substantially horizontal manner. The discharge outlet 14 is an end portion of a feed path C (which will be described later, refer to FIG. 2) of the sheet 31 on the downstream side. The printed sheet 31 is discharged from the discharge outlet 14 to the outside of the housing 2. In the concave portion 11, an interior wall 13 is provided that extends downward from an upper edge of the opening toward the discharge outlet 14. A pair of pressing ribs 15 protrude frontward from a front surface of the interior wall 13. The pressing rib 15 is a plate-like shape and is triangular in a side view. The pair of pressing ribs 15 press down the sheet 31 discharged from the discharge outlet 14, from above. A stage 12 that is substantially rectangular in a plan view extends frontward on a front side of the discharge outlet 14. The stage 12 is a resin plate provided with a plurality of ribs 16 on an upper surface thereof, the plurality of ribs 16 extending in the front-rear direction. The sheet 31 discharged from the discharge outlet 14 is pushed out onto the stage 12.

A power key 17, a cut key 18, and a FEED key 19 are disposed side by side in the left-right direction on an upper side of the concave portion 11. When the cut key 18 is pressed, a cutting device 8 (refer to FIG. 2), which is provided on an inner side of the discharge outlet 14, is driven, and the sheet 31 is cut. When the FEED key 19 is pressed, the sheet 31 is fed and discharged from the discharge outlet 14.

A connector (not shown in the drawings), to which a power supply cord is connected, and a Universal Serial Bus (USB) connector (not shown in the drawings), to which a USB cable is connected, are provided in a back surface portion of the housing 2. The printer 1 can be connected to an external device, such as a personal computer (not shown in the drawings, hereinafter referred to as a "PC") and the like, via the USB cable.

Figure 2:
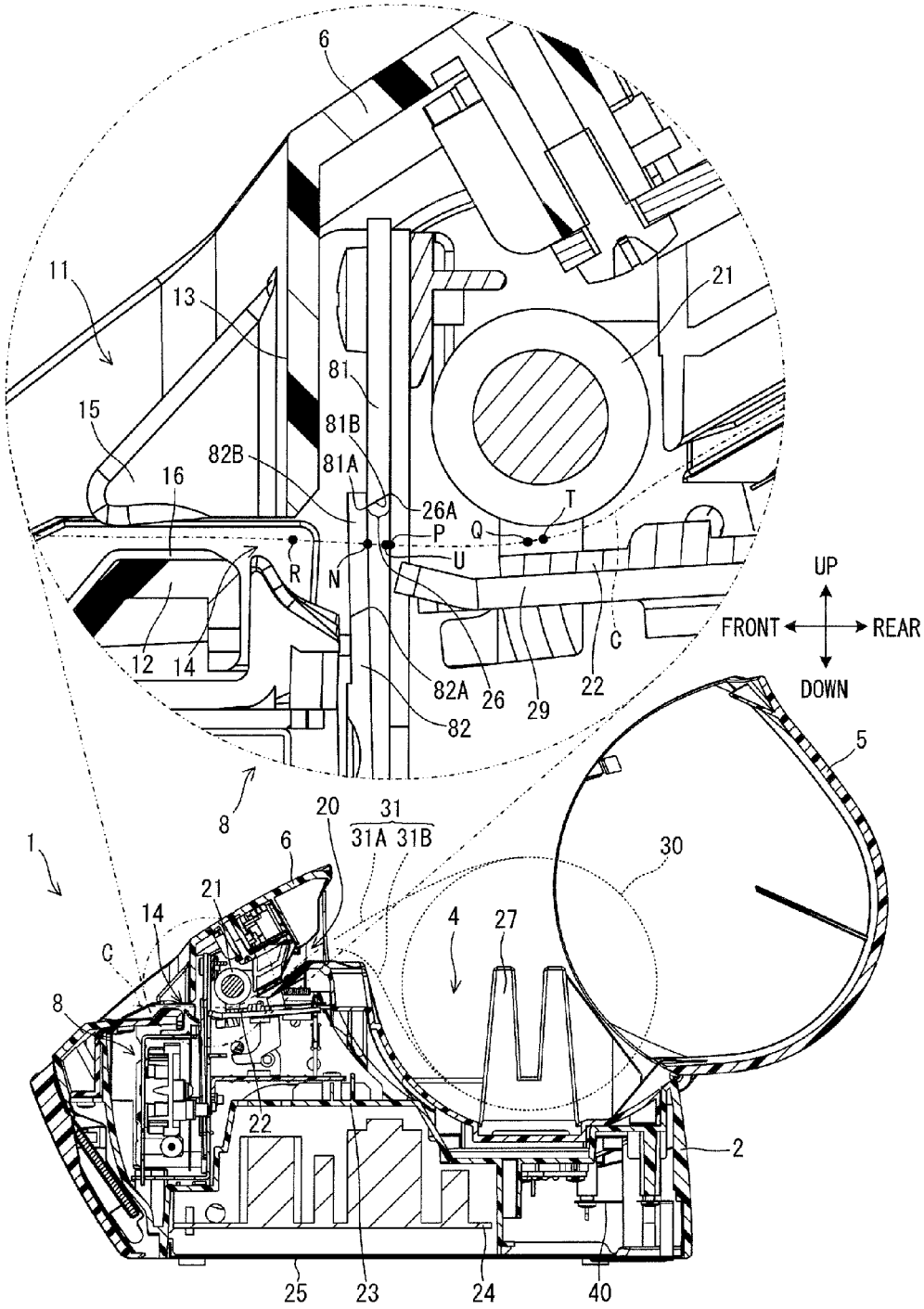
FIG. 2 is a vertical cross-sectional view of the printer 1.
Figure 3:
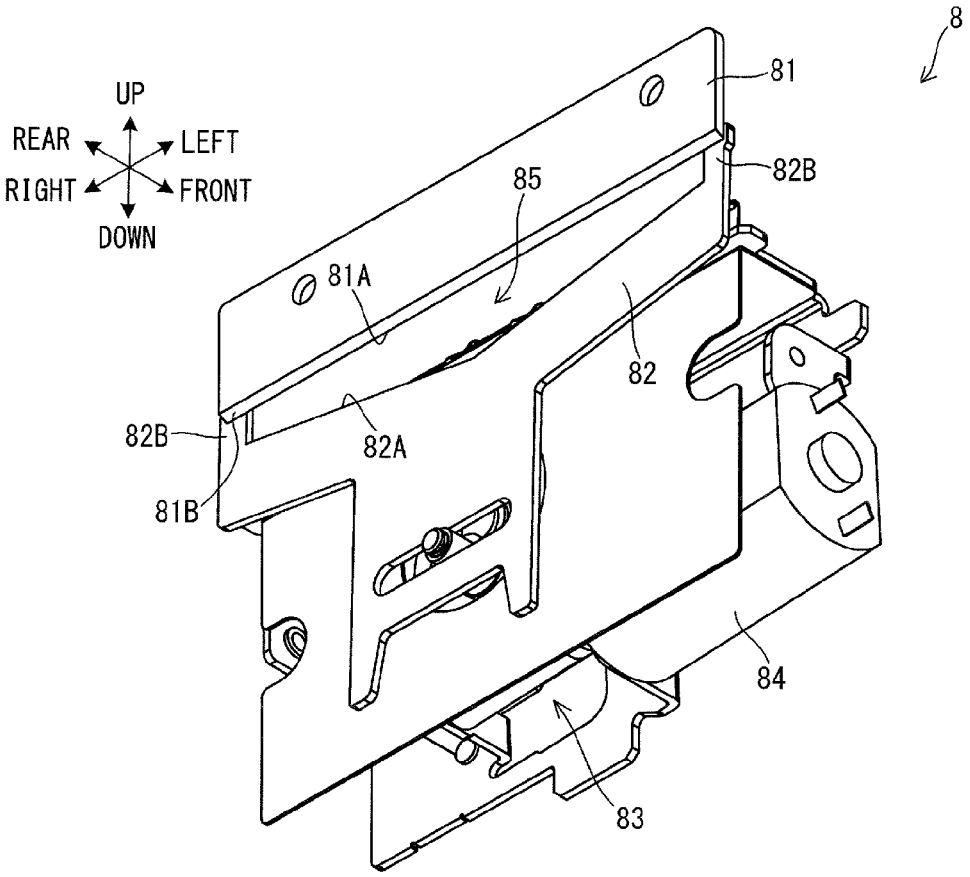
FIG. 3 is a perspective view of a cutting device 8 as viewed from the rear and the lower left side.

As shown in FIG. 2, an insertion slot 20 is provided in the front side of an upper portion of the storage portion 4. The insertion slot 20 is an end portion of the feed path C (which will be described later) of the sheet 31 on the upstream side. When the holder 3 (refer to FIG. 1) that holds the roll sheet 30 is stored in the storage portion 4, an end portion of the sheet 31 pulled out from the roll sheet 30 is inserted into the insertion slot 20. In a case where the roll sheet 30 is the inward facing roll sheet, the holder 3 is stored in the storage portion 4 so as to cause the sheet 31 to be delivered from the roll sheet 30 in the counter-clockwise direction when viewed from the right side (a sheet 31A shown in FIG. 2, for example). In a case where the roll sheet 30 is the outward facing roll sheet, the holder 3 is stored in the storage portion 4 so as to cause the sheet 31 to be delivered from the roll sheet 30 in the clockwise direction when viewed from the right side (a sheet 31B shown in FIG. 2, for example). Therefore, regardless of the winding orientation of the roll sheet 30, the sheet 31 is fed along the feed path C in a state in which the print surface faces a thermal head 22 side and a back surface faces a platen roller 21 side.

Inside the housing 2, the feed path C, along which the sheet 31 is fed, is provided from the insertion slot 20 toward the discharge outlet 14. The platen roller 21 is disposed above the feed path C. The platen roller 21 is a feed device of the sheet 31. The platen roller 21 is provided so as to be able to freely rotate around an axis thereof extending in the left-right direction. The platen roller 21 is connected to a feed motor 50 (refer to FIG. 4) via a gear that is not shown in the drawings. When the feed motor 50 is driven, the platen roller 21 is rotated in a normal direction and a reverse direction. The normal rotation of the platen roller 21 is the clockwise rotation when the platen roller 21 is viewed from the right side of the housing 2. When the platen roller 21 is rotated in the normal direction, the sheet 31 is fed toward the downstream side in the feed direction. The feed direction is a direction from the insertion slot 20 toward the discharge outlet 14 along the feed path C. The reverse direction of the platen roller 21 is the counter-clockwise direction when the platen roller 21 is viewed from the right side of the housing 2. When the platen roller 21 is rotated in the reverse direction, the sheet 31 is fed toward the upstream side in the feed direction.

The plate-shaped thermal head 22 is disposed below the feed path C at a position facing the platen roller 21. The thermal head 22 performs printing on the sheet 31. The thermal head 22 is provided with a plurality (720, for example) of heating elements (not shown in the drawings) that are disposed at the position facing the platen roller 21 and arranged in a line in the left-right direction. The thermal head 22 is supported so as to be able to come into contact with and to be separated from the platen roller 21, and is urged toward the platen roller 21. Using the heating elements, the thermal head 22 performs printing on the sheet 31 that is sandwiched between the platen roller 21 and the heating elements. A metal heat release plate 29 is fixed on a lower surface of the thermal head 22. A front end portion of the heat release plate 29 is bent upward. Hereinafter, the end portion of the sheet 31 on the downstream side in the feed direction is also referred to as a "print medium leading end portion." When the print medium leading end portion of the sheet 31, which is fed along the feed path C, droops downward due to warping, for example, the print medium leading end portion abuts against the front end portion of the heat release plate 29, and is guided into a cutting gap 85 (which will be described later) of the cutting device 8.

The cutting device 8 is provided between the platen roller 21 and the discharge outlet 14 on the downstream side of the thermal head 22 in the feed direction. As shown in FIG. 3, the cutting device 8 is provided with a fixed blade 81, a movable blade 82, a driving mechanism 83, and a cutting motor 84. In a front view, the fixed blade 81 is a substantially rectangular plate-like metal body that extends in the left-right direction and has a predetermined thickness in the front-rear direction. A cutting edge 81A of the fixed blade 81 faces downward. In a front view, the movable blade 82 is a substantially Y-shaped plate-like metal body that extends long in the left-right direction. A cutting edge 82A of the movable blade 82 is provided in a V-shape, and faces upward. The movable blade 82 is disposed in front of the fixed blade 81. Left and right end portions 82B of the movable blade 82 extend upward and abut against a front surface of the fixed blade 81.

The cutting edge 81A of the fixed blade 81 and the cutting edge 82A of the movable blade 82 face each other in the up-down direction so as to form the cutting gap 85. The feed path C (refer to FIG. 2) of the sheet 31 passes through the cutting gap 85. The driving mechanism 83 is connected to the movable blade 82, and causes the cutting motor 84 to be driven so as to cause the movable blade 82 to move in the up-down direction in a reciprocating manner. When the movable blade 82 moves upward, the end portions 82B of the movable blade 82 slide with respect to the front surface of the fixed blade 81. The end portions 82B guide the movable blade 82 to a position at which the cutting edge 82A of the movable blade 82 and the cutting edge 81A of the fixed blade 81 intersect with each other. The position at which the cutting edge 81A and the cutting edge 82A intersect with each other on the feed path C is a cut position N. The cutting device 8 cuts the sheet 31, which is positioned in the cutting gap 85, at the cut position N.

As shown in FIG. 2, a lower end surface 81B of the fixed blade 81 functions as a guide portion 26 that guides the sheet 31 that is fed along the feed path C to the cut position N. The guide portion 26 inhibits the print medium leading end portion of the sheet 31 from entering into a gap between the platen roller 21 and the cutting device 8.

A control board 40 is provided below the storage portion 4 via a partition wall 23. Control circuits, which control driving of the feed motor 50 (refer to FIG. 4), the thermal head 22, etc. based on commands from the external PC, etc., are provided on the control board 40. The thermal head 22 is connected to a connector (not shown in the drawings), which is provided on a bottom surface side of the control board 40, by a flexible flat cable (FFC) that is not shown in the drawings. A power supply board 24 is provided below the thermal head 22, the platen roller 21, etc. via the partition wall 23. Power supply circuits are formed on the power supply board 24. The control board 40 and the power supply board 24 are covered by a bottom surface cover 25 that is formed of a thin steel plate and screwed to a bottom surface portion.

Figure 4:
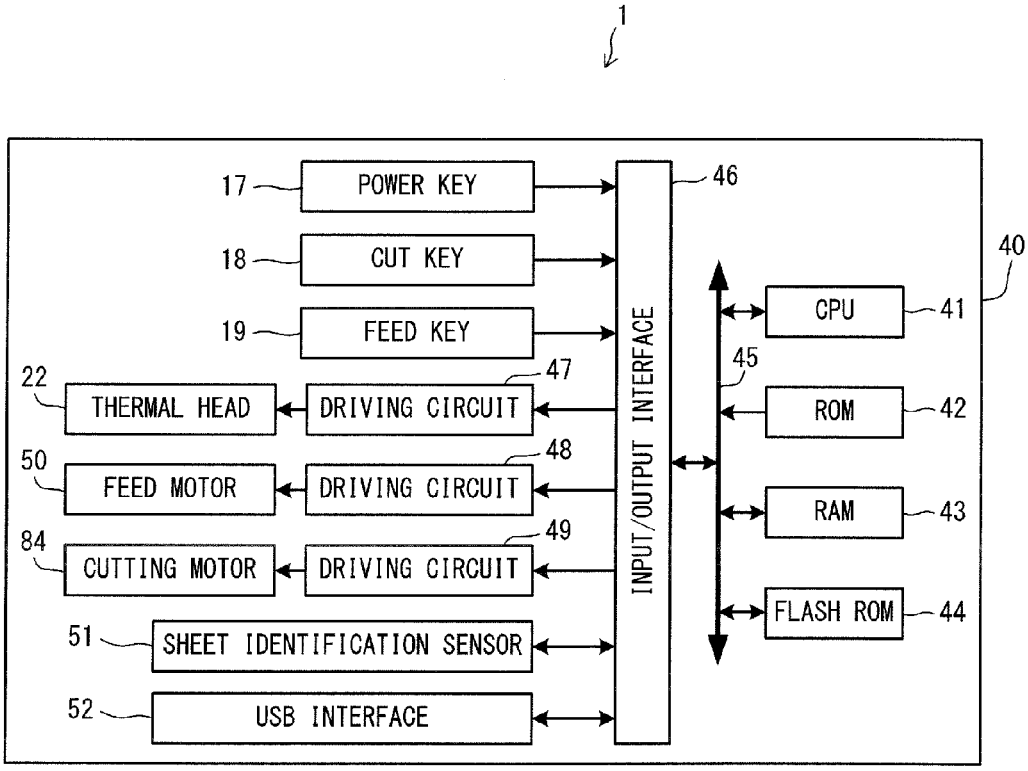
FIG. 4 is a block diagram showing an electrical configuration of the printer 1.

An electrical configuration of the printer 1 will be described with reference to FIG. 4. As shown in FIG. 4, the CPU 41, a ROM 42, a RAM 43, and a flash ROM 44 are mounted on the control board 40 of the printer 1. The CPU 41, the ROM 42, the RAM 43, and the flash ROM 44 are connected to one another by a bus 45. The CPU 41 controls the entire printer 1. Various programs necessary for controlling the printer 1, such as the print control program and the like, which will be described later, and control data, etc. necessary for the programs are stored in the ROM 42. The CPU 41 performs various operations and control processing in accordance with the programs stored in the ROM 42. A great number of character fonts are also stored in the ROM 42. In addition, an identification table for identifying the type of the sheet 31, the winding orientation of the roll sheet 30, etc. is stored in the ROM 42.

Various results of the operations performed by the CPU 41, etc. are temporarily stored in the RAM 43. Storage areas, such as a received data storage area that stores print data received from the external device, a print buffer that stores print dot pattern data when the printing is performed, a work area, and the like, are provided in the RAM 43, for example. The dot pattern data are expanded in the print buffer based on the print data received from the external device and the character fonts stored in the ROM 42. The flash ROM 44 is a non-volatile memory and stores various information.

An input/output interface 46 is connected to the bus 45. The power key 17, the cut key 18, the FEED key 19, driving circuits 47 to 49, the sheet identification sensor 51, and a USB interface 52 are connected to the input/output interface 46. The power key 17 causes a power supply of the printer 1 to be turned on and off. The cut key 18 is operated in order to cut the sheet 31 using the cutting device 8. The FEED key 19 is operated in order to feed the sheet 31. The heating elements of the thermal head 22 that performs printing on the sheet 31 are connected to the driving circuit 47. The driving circuit 47 controls a heating mode of the entire thermal head 22 by controlling a current flow to each of the heating elements based on a control signal from the CPU 41. The feed motor 50 that causes the platen roller 21 (refer to FIG. 2) to rotate is connected to the driving circuit 48, the platen roller 21 feeding the sheet 31. The driving circuit 48 controls driving of the feed motor 50 based on the control signal from the CPU 41. A known stepping motor, a known servo motor, or the like is used as the feed motor 50, for example. The driving circuit 48 controls the rotation direction (the normal rotation and the reverse rotation) and a rotation amount of the feed motor 50.

The cutting motor 84 of the cutting device 8 is connected to the driving circuit 49. The driving circuit 49 controls driving of the cutting motor 84 based on the control signal from the CPU 41, and causes the cutting device 8 to cut the sheet 31. As described above, the sheet identification sensor 51 is configured by the plurality of switches (not shown in the drawings). Each of the switches outputs to the CPU 41 a signal that indicates an ON/OFF state. The USB connector (not shown in the drawings) is connected to the USB interface 52. The USB interface 52 receives data from and sends data to the external device connected to the printer 1 via the USB cable. The CPU 41 controls the printing in accordance with the print data received from the external device via the USB interface 52.

The print control program that is executed in the printer 1 of the present embodiment will be described with reference to FIG. 5. When the CPU 41 receives an operation input on the power key 17 by the user, the CPU 41 starts up the printer 1. The CPU 41 reads the print control program stored in the ROM 42, expands the program in the RAM 43, and starts running the print control program. The CPU 41 performs initial processing (step S11). The CPU 41 secures a storage area that is used for the print control program in the RAM 43. The CPU 41 reads data used by the program, such as various flags and initial values of variables, from the ROM 42 or the flash ROM 44, stores the data in the RAM 43, and performs initialization. Further, the CPU 41 performs an operation check of the thermal head 22, the feed motor 50, etc.

The CPU 41 obtains a state of each of the switches of the sheet identification sensor 51. The CPU 41 obtains the information of the sheet 31 corresponding to the combination of the ON/OFF states of the sheet identification sensor 51 based on the identification table stored in the ROM 42. The CPU 41 stores the information of the sheet 31 in the RAM 43, the information including the type and size of the sheet 31, the winding orientation of the roll sheet 30, etc. (step S13).

The CPU 41 determines whether or not it has received an operation input on the FEED key 19 (step S15). When there is no operation of the FEED key 19 (no at step S15), the CPU 41 advances the processing to step S19. When the CPU 41 has received the operation input on the FEED key 19 (yes at step S15), the CPU 41 outputs the control signal to the driving circuit 48 to cause the feed motor 50 to be driven, and causes the platen roller 21 to be rotated in the normal direction by a first amount (step S17). The first amount is a rotation amount of the platen roller 21 that corresponds to an amount that causes the sheet 31 to be fed toward the downstream side in the feed direction by approximately 25 mm, for example. After controlling the feeding of the sheet 31, the CPU 41 advances the processing to step S19.

The CPU 41 determines whether or not it has received an operation input on the cut key 18 (step S19). When there is no operation of the cut key 18, (no at step S19), the CPU 41 advances the processing to step S23. When the CPU 41 has received the operation input on the cut key 18 (yes at step S19), the CPU 41 outputs the control signal to the driving circuit 49 to cause the cutting motor 84 of the cutting device 8 to be driven. The driving circuit 49 causes the movable blade 82 to move upward, and after causing the cutting edge 82A to intersect with the cutting edge 81A of the fixed blade 81, causes the movable blade 82 to move downward so as to open the cutting gap 85. When the sheet 31 is positioned at the cut position N on the feed path C, the sheet 31 is cut by the cutting device 8. After controlling the driving of the cutting device 8, the CPU 41 advances the processing to step S23.

When the print data is sent from the external device, the CPU 41 determines whether or not the reception of the print data is complete (step S23). When the print data is not sent from the external device, or when the print data is still being received, the CPU 41 advances the processing to step S27. When the reception of the print data sent from the external device is complete (yes at step S23), the CPU 41 advances the processing to step S25, and performs print processing (refer to FIG. 6). The print processing will be described later. After the print processing is completed, the CPU 41 advances the processing to step S27.

The CPU 41 determines whether or not it has received the operation input on the power key 17 (step S27). When there is no operation of the power key 17 (no at step S27), the CPU 41 returns the processing to step S15. After that, the CPU 41 repeatedly performs the processing from step S15 to step S27, and stands by until it receives the key operation input or receives the print data. When the CPU 41 has received the operation input on the power key 17 (yes at step S27), the CPU 41 performs processing required at the time of ending the print control program (step S29), and ends the program after releasing the storage area in the RAM 43.

Figure 6:
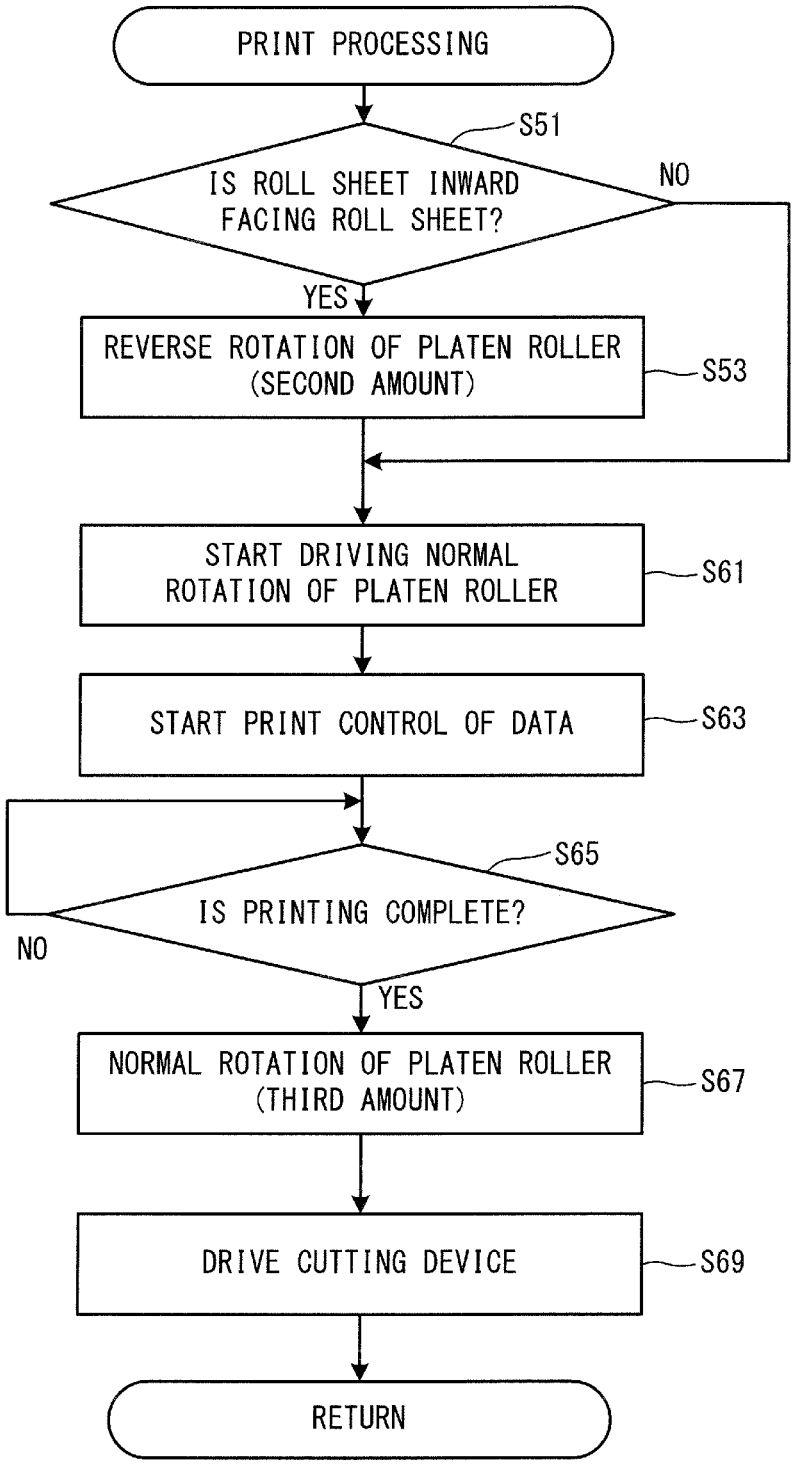
FIG. 6 is a flowchart of print processing.

Next, the print processing in which the inward facing roll sheet is used as the roll sheet 30 will be described. As described above, when the reception of the print data from the external device is complete, the CPU 41 performs the print processing (step S25). As shown in FIG. 6, the CPU 41 determines whether or not the roll sheet 30 is the inward facing roll sheet based on the information of the sheet 31 stored in the RAM 43 (step S51). In a case where the roll sheet 30 is the inward facing roll sheet (yes at step S51), the CPU 41 outputs the control signal to the driving circuit 48, and causes the platen roller 21 to be rotated in the reverse direction by a second amount (step S53). After causing the sheet 31, on which the printing has been completed, to be cut, the printer 1 of the present embodiment maintains a state in which the print medium leading end portion of the sheet 31 is positioned at the cut position N until the next print processing is performed. The second amount is a rotation amount of the platen roller 21 that corresponds to an amount that causes the print medium leading end portion of the sheet 31 to be fed from the cut position N to a position Q. The position Q is a position on the feed path C that is positioned further to the downstream side in the feed direction than a position at which the platen roller 21 abuts against the thermal head 22 at the time of the printing, and that is positioned further to the upstream side in the feed direction than a position P of an end portion 26A that is positioned on the upstream side in the feed direction of the guide portion 26. More specifically, the position Q is a position in which the print medium leading end portion of the sheet 31 can be caused to be closer to a print position T of the thermal head 22 and a state can be maintained in which the sheet 31 is sandwiched between the platen roller 21 and the thermal head 22 at the time of the printing. The print position T is a position that corresponds to the heating elements on the feed path C. By feeding the print medium leading end portion of the sheet 31 to the position Q before the printing is performed on the sheet 31, the printer 1 can cause the print medium leading end portion to be closer to the print position T and can further reduce a margin section on which the printing cannot be performed on the sheet 31. After controlling the feeding of the sheet 31, the CPU 41 advances the processing to step S61.

The CPU 41 outputs the control signal to the driving circuit 48 and causes the platen roller 21 to be rotated in the normal direction (step S61). The platen roller 21 starts feeding the sheet 31 toward the downstream side in the feed direction. The CPU 41 expands the print data, which has been completely received from the external device, in the print buffer, and creates the dot pattern data. The CPU 41 outputs the control signal to the driving circuit 47 so as to cause the driving circuit 47 to control the current flow to each of the heating elements based on the dot pattern data, and starts the printing on the sheet 31 (step S63). As the sheet 31 is fed, characters are printed on the print surface of the sheet 31 based on the print data (no at step S65).

As the printing proceeds, the print medium leading end portion of the sheet 31 passes through the position P of the end portion 26A of the guide portion 26 along the feed path C. As the roll sheet 30 is the inward facing roll sheet, the print medium leading end portion of the sheet 31 retains an effect of having been held with the print surface facing the inner peripheral side while the printing is not performed, and the print surface therefore tends to warp inward. As a result, the print medium leading end portion of the sheet 31 tends to move downward while being fed toward the downstream side in the feed direction. A gap between the end portion 26A of the guide portion 26 and the platen roller 21 is positioned above the feed path C. Thus, the medium leading end portion of the sheet 31 is unlikely to enter into the gap between the guide portion 26 and the platen roller 21.

When the printing based on the print data is complete (yes at step S65), the CPU 41 causes the platen roller 21 to be rotated in the normal direction by a third amount (step S67). The third amount is a rotation amount of the platen roller 21 that corresponds to a length obtained by adding a length that is preset as the margin section of the print surface of the sheet 31 and a length from the print position T to the cut position N on the feed path C. As a result of the platen roller 21 being rotated in the normal direction by the third amount, the sheet 31 is in a state in which a printed section and the margin section are positioned further to the downstream side in the feed direction than the cut position N.

The CPU 41 outputs the control signal to the driving circuit 49, and causes the cutting motor 84 of the cutting device 8 to be driven (step S69). The cutting device 8 separates the printed section of the sheet 31 and the margin section at the cut position N. The print medium leading end portion of the sheet 31 is positioned at the cut position N. The CPU 41 ends the print processing, and advances the processing to step S27 of a main routine (refer to FIG. 5).

In this manner, in a case where the roll sheet 30 is the inward facing roll sheet, after completing the reception of the print data and performing the print processing, the CPU 41 causes the print medium leading end portion of the sheet 31 to be fed to the position Q, which is positioned further to the upstream side in the feed direction than the position P of the end portion 26A of the guide portion 26, and after that, starts the printing. As a result, the printer 1 can reduce the margin section of the print surface on which printing cannot be performed.

Meanwhile, the print processing in which the outward facing roll sheet is used as the roll sheet 30 will be described. When the CPU 41 performs the print processing, the CPU 41 determines whether or not the roll sheet 30 is the inward facing roll sheet based on the information of the sheet 31 stored in the RAM 43 (step S51). In a case where the roll sheet 30 is the outward facing roll sheet (no at step S51), the CPU 41 advances the processing to step S61. The CPU 41 performs the processing from step S61 to step S65, and prints characters on the print surface of the sheet 31 based on the print data in substantially the same manner as described above.

As the roll sheet 30 is the outward facing roll sheet, the print medium leading end portion of the sheet 31 retains an effect of having been held with the print surface facing the outer peripheral side while the printing is not performed, and the print surface therefore tends to warp outward. As a result, the print medium leading end portion of the sheet 31 tends to move upward while being fed toward the downstream side in the feed direction. Thus, in a case where the roll sheet 30 is the outward facing roll sheet, the printer 1 starts the printing on the sheet 31 while maintaining a state in which the print medium leading end portion of the sheet 31 is positioned at the cut position N. More specifically, the printing on the sheet 31 is started in a state in which the print medium leading end portion is positioned further to the downstream side than the end portion 26A of the guide portion 26. Thus, the print medium leading end portion of the sheet 31 does not enter into the gap between the guide portion 26 and the platen roller 21.

When the printing is completed (yes at step S65), the CPU 41 causes the platen roller 21 to be rotated in the normal direction by the third amount (step S67). The CPU 41 causes the cutting device 8 to be driven, and separates the printed section of the sheet 31 and the margin section at the cut position N. In substantially the same manner as described above, the print medium leading end portion of the sheet 31 is positioned at the cut position N. The CPU 41 ends the print processing, and advances the processing to step 27 of the main routine (refer to FIG. 5).

In this manner, in a case where the roll sheet 30 is the outward facing roll sheet, after completing the reception of the print data and performing the print processing, the CPU 41 starts printing without causing the sheet 31 to be fed toward the upstream side in the feed direction at all. Thus, even when the sheet 31 retains the effect generated by being held with the print surface facing the outer peripheral side while the printing is not performed, and the print surface is warped outward, the print medium leading end portion of the sheet 31 does not enter into the gap between the guide portion 26 and the platen roller 21. As a result, the printer 1 can inhibit sheet jamming from occurring.

As described above, in a case where the roll sheet 30 is the inward facing roll sheet, the printer 1 feeds the print medium leading end portion of the sheet 31 further to the upstream side in the feed direction than the end portion 26A of the guide portion 26 before the printing is performed, and then, performs the printing. Thus, the printer 1 can reduce the margin section of the print surface on which the printing is not performed. In a case where the roll sheet 30 is the outward facing roll sheet, the printer 1 starts performing the printing in a state in which the print medium leading end portion is positioned further to the downstream side in the feed direction than the end portion 26A of the guide portion 26. Thus, even when the sheet 31 retains the effect generated by being held with the print surface facing the outer peripheral side while the printing is not performed, and the print surface is warped outward, the print medium leading end portion of the sheet 31 does not enter into the gap between the guide portion 26 and the platen roller 21. As a result, the printer 1 can inhibit the sheet jamming from occurring.

Note that the present disclosure is not limited to the above-described embodiment, and various modifications can be made thereto. The CPU 41 identifies whether the roll sheet 30 is the inward facing roll sheet or the outward facing roll sheet based on identification information printed on the back surface of the sheet 31. The present disclosure is not limited to this example, and the printer 1 may include a plurality of switches in the storage portion 4, for example. In this case, the holder 3 may include a plurality of pins that correspond to each of the switches and have different combinations according to the type of the sheet 31. The CPU 41 may obtain information about an ON/OFF combination of the switches based on the combination of the pins, and may identify the winding orientation of the roll sheet 30 based on the information.

Alternatively, the CPU 41 may allow the inward facing roll sheet or the outward facing roll sheet to be designated by causing the designation to correspond to the operation of the cut key 18 or the FEED key 19. In this case, the CPU 41 may identify the winding orientation of the roll sheet 30 by receiving a key operation input in sheet identification processing (step S13).

Further, the printer 1 uses the heat-sensitive sheet as the sheet 31 and performs the printing using a heat-coloring method. However, the sheet 31 is not limited to the heat-sensitive sheet, and may be a general print paper or transfer paper, etc. Further, the printing may be performed using other known methods, such as an inkjet method, a laser method, a transfer ribbon method, a dot impact method, and the like.

In the present embodiment, the lower end surface 81B of the fixed blade 81 functions as the guide portion 26. The present disclosure is not limited to this example, and a member having a wall surface, which can cause the print medium leading end portion to slide thereon and can guide the print medium leading end portion to the end surface 81B of the fixed blade 81 even when the print medium leading end portion of the sheet 31 is warped upward, may be provided on the rear side of the fixed blade 81, and the wall surface may function as the guide portion 26.

Figure 7:
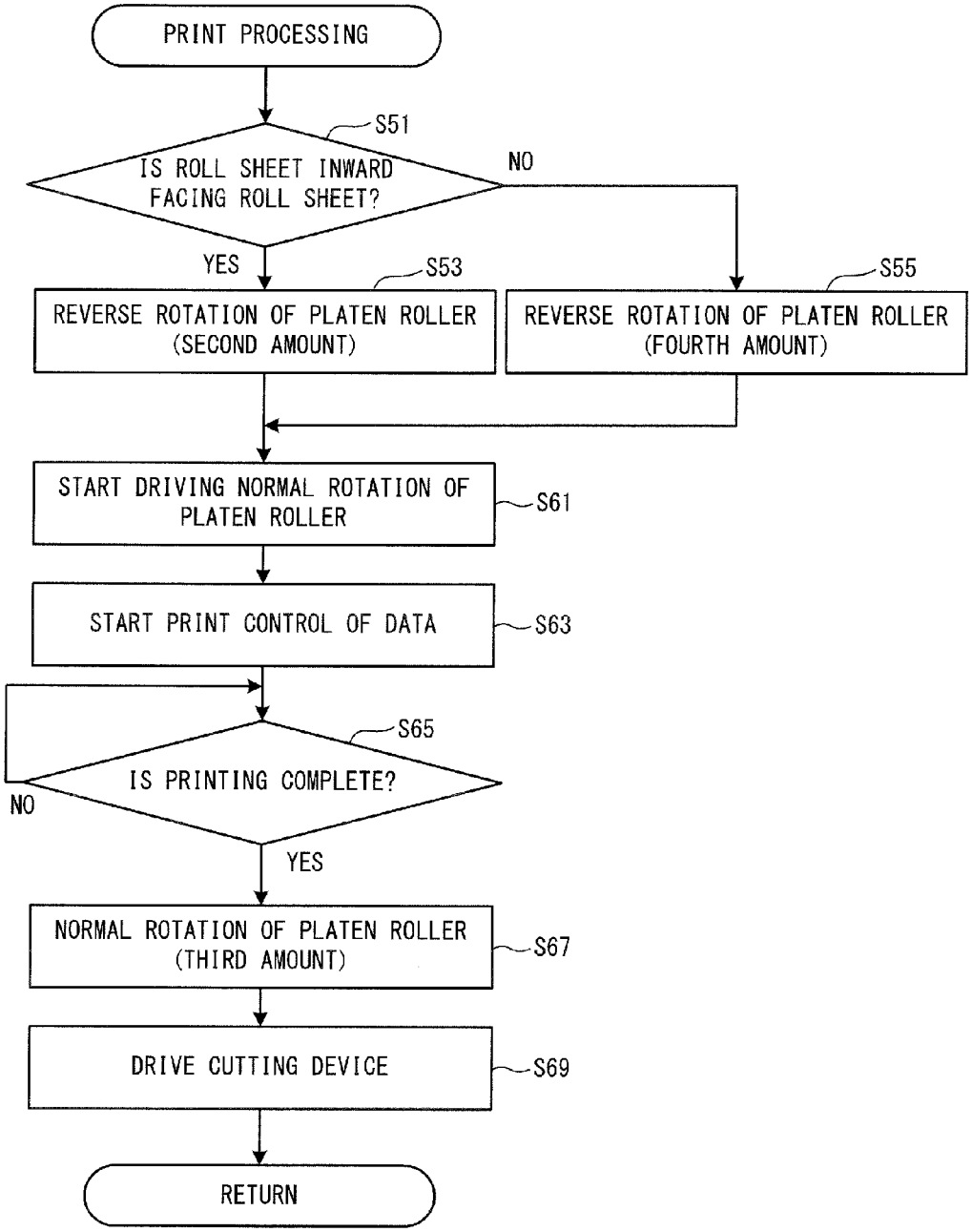
FIG. 7 is a flowchart of a first modified example of the print processing.

Further, in the print processing, even when the roll sheet 30 is the outward facing roll sheet, the sheet 31 may be fed toward the upstream side in the feed direction before the printing is performed. For example, in a first modified example of print processing shown in FIG. 7, when the CPU 41 determines that the roll sheet 30 is the outward facing roll sheet in the processing at step S51 (no at step S51), the CPU 41 advances the processing to step S61 after causing the platen roller 21 to be rotated in the reverse direction by a fourth amount (step S55). In substantially the same manner as in the present embodiment, after cutting the sheet 31 on which the printing has been completed, the printer 1 maintains a state in which the print medium leading end portion of the sheet 31 is positioned at the cut position N until the next print processing is performed. The fourth amount is a rotation amount of the platen roller 21 that corresponds to an amount that causes the print medium leading end portion of the sheet 31 to be fed from the cut position N to a position U. The position U is a position that is positioned further to the upstream side in the feed direction than the cut position N and further to the downstream side in the feed direction than the position P of the end portion 26A of the guide portion 26. The position U corresponds to a section in which the guide portion 26 is formed on the feed path C. More specifically, the position U is a position in which the print medium leading end portion of the sheet 31 can be closer to the print position T of the thermal head 22 and the print medium leading end portion can be positioned further to the downstream side in the feed direction than the gap between the guide portion 26 and the platen roller 21. As a result, even when the roll sheet 30 is the outward facing roll sheet, the printer 1 can further reduce the margin section on which the printing cannot be performed on the sheet 31. Note that other processing (steps S61 to S69) in the print processing (the first modified example) is substantially the same as that of the present embodiment.

In this manner, in a case where the roll sheet 30 is the outward facing roll sheet, after the printing is completed, a state is maintained in which the print medium leading end portion of the sheet 31 is positioned at the cut position N. After completing the reception of the print data and performing the print processing, the CPU 41 causes the print medium leading end portion of the sheet 31 to be fed to the position U that is positioned further to the upstream side in the feed direction than the position P of the end portion 26A of the guide portion 26, and then starts the printing. Thus, the printer 1 can reduce the margin section of the print surface on which the printing is not performed. Further, even when the sheet 31 retains the effect generated by being held with the print surface facing the outer peripheral side of the roll sheet 30 while the printing is not performed, and the print surface is warped outward, the print medium leading end portion of the sheet 31 does not enter into the gap between the guide portion 26 and the platen roller 21. As a result, the printer 1 can inhibit the sheet jamming from occurring.

Figure 8:
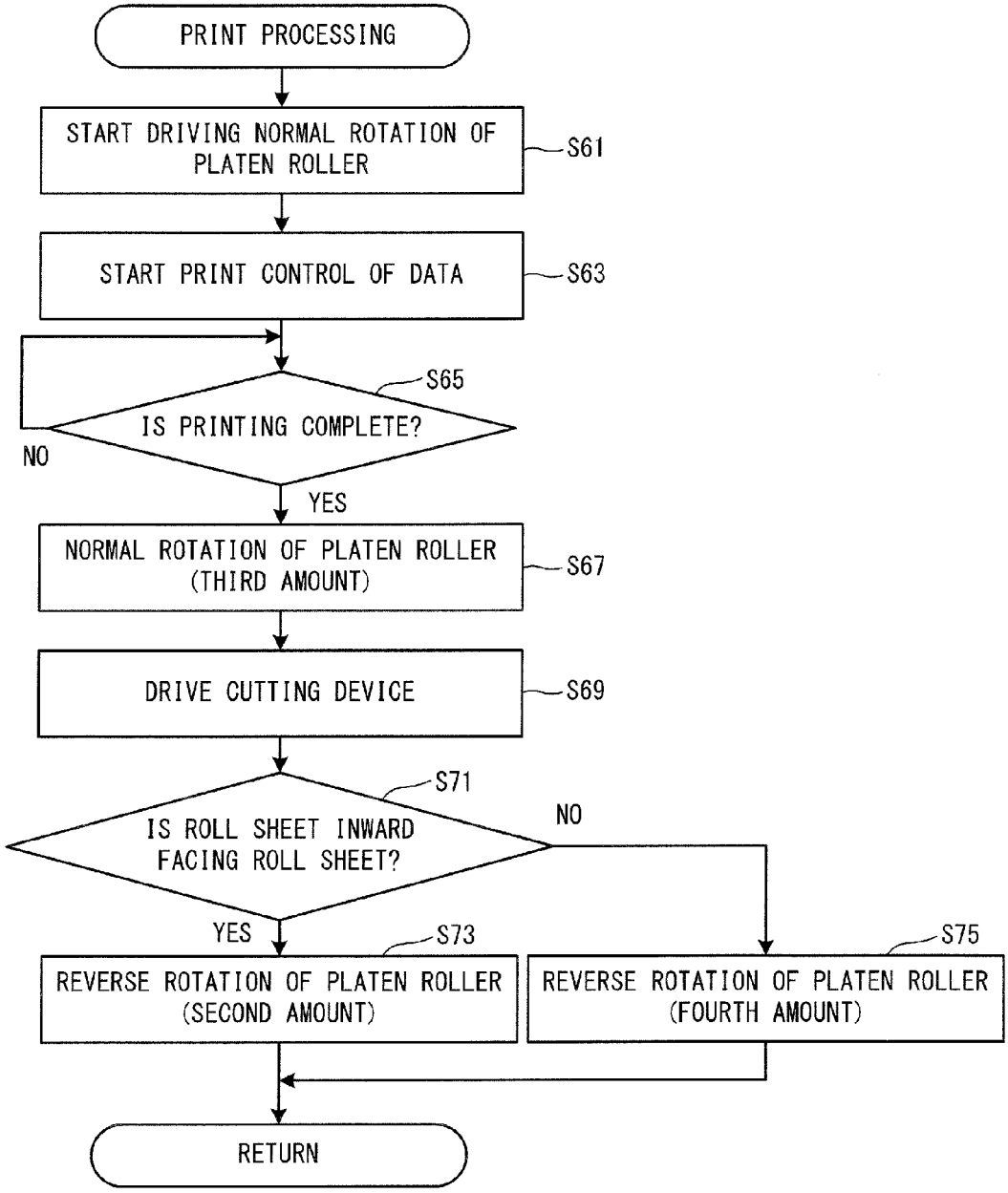
FIG. 8 is a flowchart of a second modified example of the print processing.

Further, in the print processing, the sheet 31 may be fed toward the upstream side in the feed direction after the printing is completed, and then, after the print data is received, the printing may be started right away. For example, in a second modified example of the print processing shown in FIG. 8, after the printing is completed (yes at step S65), the CPU 41 causes the sheet 31 to be cut (step S69), and then determines whether or not the roll sheet 30 is the inward facing roll sheet (step S71). In a case where the roll sheet 30 is the inward facing roll sheet (yes at step S71), the CPU 41 causes the platen roller 21 to be rotated in the reverse direction by the second amount (step S73), ends the print processing, and then returns the processing to the main routine (refer to FIG. 5). While the printing is not being performed, the print medium leading end portion of the sheet 31 is maintained in a state of being positioned at the position Q that is positioned near the print position T. When the next print processing is performed based on the print data received from the external device, the CPU 41 performs the processing from step S61 to step S69, and performs the printing and the cutting of the sheet 31 in substantially the same manner as in the present embodiment.

In this manner, in a case where the roll sheet 30 is the inward facing roll sheet, after the printing is completed on the sheet 31, the CPU 41 can cause the print medium leading end portion to be fed to the position Q, which is positioned further to the upstream side in the feed direction than the position P of the end portion 26A of the guide portion 26, in advance before the next print data is received. Thus, after completing the reception of the print data and performing the print processing, the printer 1 can immediately start printing on the sheet 31. Further, the printer 1 can reduce the margin section of the print surface on which the printing is not performed.

Figure 5:
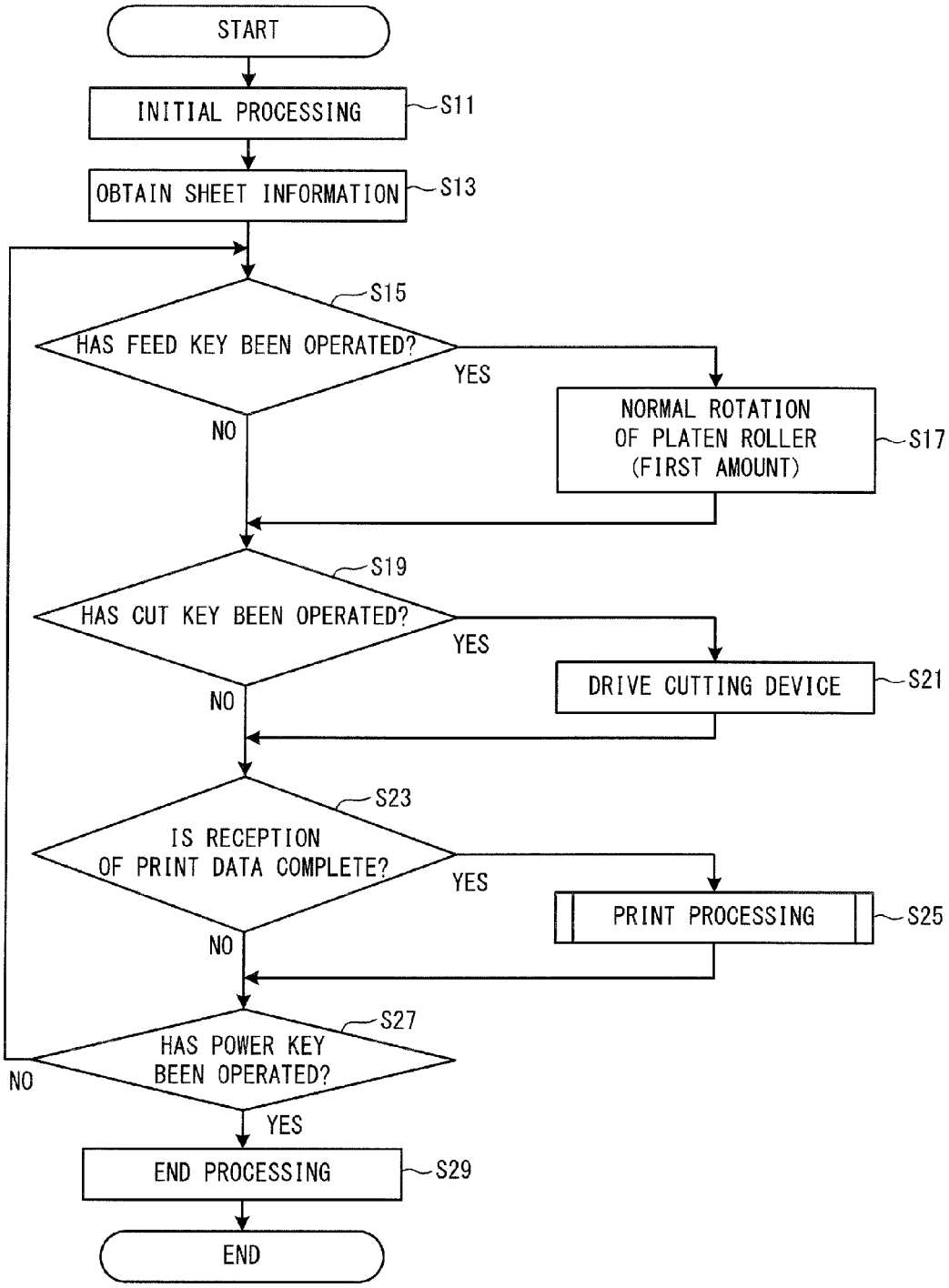
FIG. 5 is a flowchart of a print control program.

Further, in the second modified example (refer to FIG. 8) of the above-described print processing, in a case where the roll sheet 30 is the outward facing roll sheet (no at step S71), the CPU 41 may cause the platen roller 21 to be rotated in the reverse direction by the fourth amount (step S75) first, and may then end the print processing and return the processing to the main routine (refer to FIG. 5). While the printing is not being performed, the print medium leading end portion of the sheet 31 is maintained in a state of being positioned at the position U that is positioned near the position P of the end portion 26A of the guide portion 26 and that corresponds to the guide portion 26. When the next print processing is performed based on the print data received from the external device, the CPU 41 performs the processing from step S61 to step S69, and performs the printing and the cutting of the sheet 31 in substantially the same manner as in the present embodiment.

In this manner, in a case where the roll sheet 30 is the outward facing roll sheet, after the printing is completed on the sheet 31, the CPU 41 can cause the print medium leading end portion to be fed to the position U, which is positioned further to the upstream side in the feed direction than the cut position N and further to the downstream side than the position P of the end portion 26A of the guide portion 26, in advance before the next print data is received. Thus, after completing the reception of the print data and performing the print processing, the printer 1 can immediately start printing on the sheet 31. Further, the printer 1 can reduce the margin section of the print surface on which the printing is not performed. Furthermore, even when the sheet 31 retains the effect generated by being held with the print surface facing the outer peripheral side of the roll sheet 30 while the printing is not performed, and the print surface is warped outward, the print medium leading end portion of the sheet 31 does not enter into the gap between the guide portion 26 and the platen roller 21 because it is positioned further to the downstream side than the end portion 26A of the guide portion 26. As a result, the printer 1 can inhibit the sheet jamming from occurring.

Figure 9:
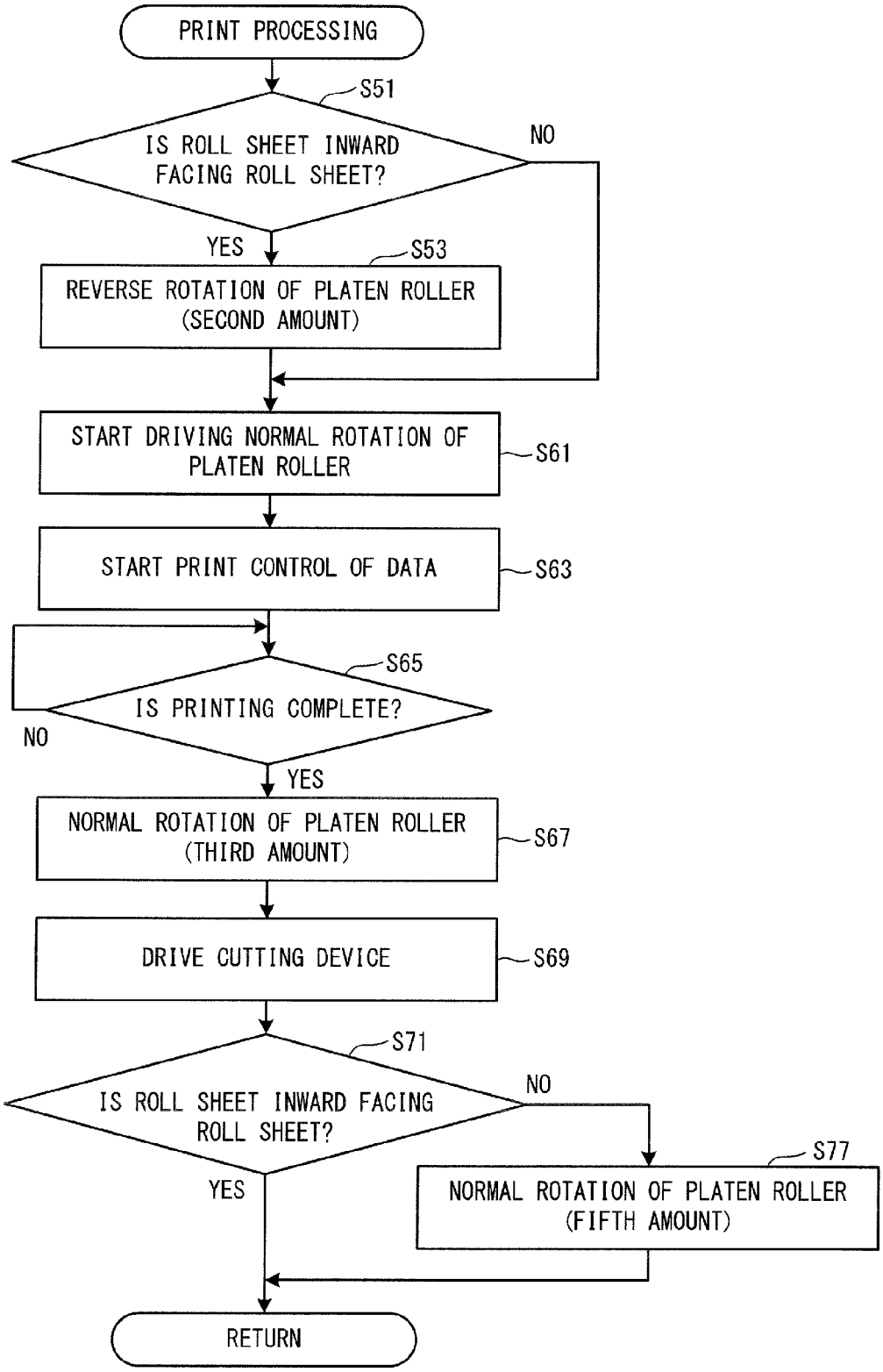
FIG. 9 is a flowchart of a third modified example of the print processing.

Further, in the print processing, in a case where the roll sheet 30 is the outward facing roll sheet, after the printing is completed, the print medium leading end portion of the sheet 31 may be fed to a position R that corresponds to the discharge outlet 14 on the feed path C. For example, in a third modified example of the print processing shown in FIG. 9, after completing the printing (yes at step S65) and causing the sheet 31 to be cut (step S69), the CPU 41 determines whether or not the roll sheet 30 is the inward facing roll sheet (step S71). In a case where the roll sheet 30 is the inward facing roll sheet (yes at step S71), the CPU 41 ends the print processing and returns the processing to the main routine (refer to FIG. 5). In a case where the roll sheet 30 is the outward facing roll sheet (no at step S71), the CPU 41 causes the platen roller 21 to be rotated in the normal direction by a fifth amount (step S77), ends the print processing, and then returns the processing to the main routine (refer to FIG. 5). The fifth amount is a rotation amount of the platen roller 21 that corresponds to an amount that causes the print medium leading end portion of the sheet 31 to be fed from the cut position N to the position R of the discharge outlet 14. While the printing is not being performed, the print medium leading end portion of the sheet 31, which is the outward facing roll sheet, is maintained in a state of being positioned at the discharge outlet 14. The position R of the discharge outlet 14 is positioned further to the front side than the cut position N and is separated from the cut position N. Thus, even when the sheet 31 retains the effect generated by being held with the print surface facing the outer peripheral side while the printing is not performed, and the print surface is warped upward, an upward movement of the medium leading end portion is suppressed as it abuts against an upper wall of the discharge outlet 14, and the print medium leading end portion is inhibited from warping to a large extent. When the next print processing is performed based on the print data received from the external device, and in a case where the roll sheet 30 is the outward facing roll sheet (no at step S51), the CPU 41 performs the processing from step S61 to step S69, and performs the printing and the cutting of the sheet 31 in substantially the same manner as in the present embodiment. In a case where the roll sheet 30 is the inward facing roll sheet, the CPU 41 causes the print medium leading end portion to be fed to the position Q, performs the processing from step S61 to step S69, and then performs the printing and the cutting of the sheet 31 in substantially the same manner as in the present embodiment.

In this manner, in a case where the roll sheet 30 is the outward facing roll sheet, the CPU 41 causes the print medium leading end portion of the sheet 31 to be positioned at the discharge outlet 14 after the printing is completed. As a result, even when the sheet 31 retains the effect generated by being held with the print surface facing the outer peripheral side while the printing is not performed, and the print surface is warped outward, the sheet 31 is inhibited from warping to a large extent as the warping of the print medium leading end portion is suppressed by the discharge outlet 14. As the discharge outlet 14 is a part that connects the housing 2 of the printer 1 to the outside, the printer 1 can reliably inhibit the sheet jamming from occurring by discharging the print medium leading end portion from the discharge outlet 14 at the time of the printing.

Note that, in the third modified example of the above-described print processing, even when the roll sheet 30 is the inward facing roll sheet, the CPU 41 may cause the print medium leading end portion of the sheet 31 to be positioned at the discharge outlet 14 after the printing is completed, in substantially the same manner as in a case where the roll sheet 30 is the outward facing roll sheet. Further, in the third modified example, when the print data is received and the printing is started, in a case where the roll sheet 30 is the inward facing roll sheet, the CPU 41 may cause the print medium leading end portion to be fed to the position Q, and in a case where the roll sheet 30 is the outward facing roll sheet, the CPU 41 may cause the print medium leading end portion to be fed to the position U. In this case, in a case where the roll sheet 30 is the outward facing roll sheet, it is only necessary for the CPU 41 to cause the platen roller 21 to be rotated in the reverse direction by an amount that is obtained by adding the fifth amount to the fourth amount, before the printing is started. In a case where the roll sheet 30 is the inward facing roll sheet, it is only necessary for the CPU 41 to cause the platen roller 21 to be rotated in the reverse direction by an amount that is obtained by adding the fifth amount to the second amount, before the printing is started.

Figure 10:
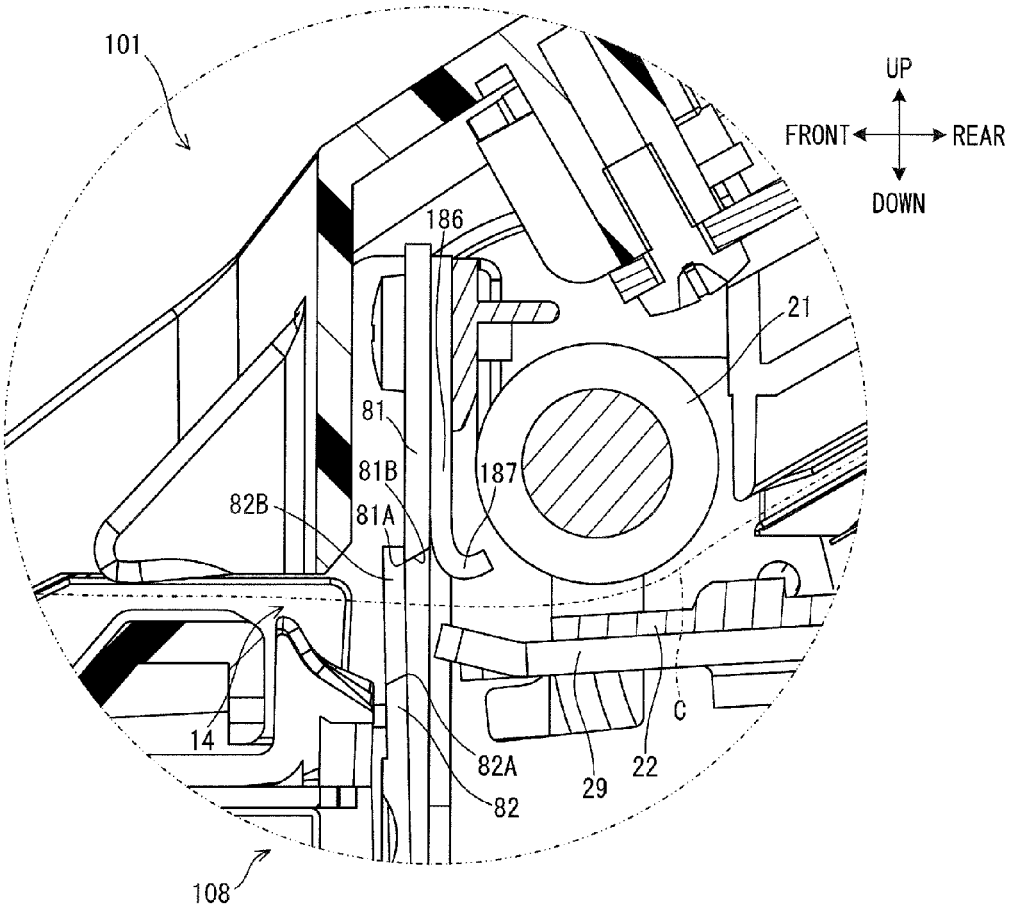
FIG. 10 is a vertical cross-sectional view of a printer 101.

Further, as in a printer 101 shown in FIG. 10, a pushing down plate 186, which is substantially rectangular and plate-shaped in a front view and extends in the left-right direction, may be provided on the rear side of the fixed blade 81 of a cutting device 108. A protruding portion 187 is formed in a lower end portion of the pushing down plate 186. The protruding portion 187 is provided so as to be formed in a shape that is obtained by folding back a lower edge portion of the pushing down plate 186 in the rearward direction. A lower end of the protruding portion 187 is positioned below the cutting edge 81A of the fixed blade 81. The protruding portion 187 protrudes inside the feed path C from the upper side toward the lower side. The protruding portion 187 extends in the left-right direction inside the feed path C and intersects with the feed direction.

The protruding portion 187 can press the sheet 31, which is fed along the feed path C, toward the inside of the feed path C. Thus, in a case in which the roll sheet 30 is the outward facing roll sheet, even when the sheet 31 retains the effect generated by being held with the print surface facing the outer peripheral side while the printing is not performed, and the print surface is warped outward, the protruding portion 187 can push the sheet 31 back toward the inside of the feed path C. As a result, the printer 101 can inhibit the sheet jamming from occurring.

What is claimed is:

1. A printer comprising:

a storage portion configured to store a roll sheet as a print medium, the print medium being a long sheet-shaped medium, a release paper being adhered to a back surface of the print medium by an adhesive, and the back surface being an opposite side of a print surface;

a feeding portion configured to feed the print medium pulled out from the storage portion along a longitudinal direction of the print medium;

a printing portion configured to perform printing on the print surface of the print medium fed by the feeding portion;

a cutting portion provided separately from the printing portion and further to a downstream side in a feed direction of the print medium than the printing portion, and configured to cut the print medium printed by the printing portion;

a guide portion provided between the printing portion and a cutting position of the cutting portion and separately from the printing portion, and configured to guide the print medium fed by the feeding portion to the cutting position;

a processor; and a memory configured to store computer-readable instructions that, when executed by the processor, cause the printer to perform processes comprising:

determining whether the roll sheet stored in the storage portion is an inward facing roll sheet or an outward facing roll sheet, the inward facing roll sheet being a sheet that is wound with the print surface facing an inner peripheral side, and the outward facing roll sheet being a sheet that is wound with the print surface facing an outer peripheral side;

controlling, in a case where it is determined that the roll sheet is the inward facing roll sheet, before the printing on the print medium is performed by the printing portion, the feeding portion so as to cause a print medium leading end portion to be moved from the cutting position and to be positioned further to an upstream side in the feed direction than an upstream end portion, and controlling the printing portion so as to cause the printing on the print medium to be started after the controlling of the feeding portion is completed, the print medium leading end portion being a downstream-side end portion of the print medium in the feed direction and the upstream end portion being an upstream-side end portion of the guide portion in the feed direction; and controlling, in a case where it is determined that the roll sheet is the outward facing roll sheet, the printing portion so as to cause the printing on the print medium to be started in a state in which the print medium leading end portion is positioned further to the downstream side in the feed direction than the upstream end portion.

2. The printer according to claim 1, wherein, in a case where it is determined that the roll sheet is the inward facing roll sheet, the controlling of the feeding portion includes, when the processor has received print data for printing, controlling the feeding portion so as to cause the print medium leading end portion to be positioned further to the upstream side in the feed direction than the upstream end portion before controlling the printing portion so as to cause the printing on the print medium to be started.

3. The printer according to claim 1, wherein in a case where it is determined that the roll sheet is the inward facing roll sheet, the controlling of the feeding portion includes controlling the feeding portion, after the print medium is cut by the cutting portion and before the processor receives print data for printing, so as to cause the print medium leading end portion to be positioned further to the upstream side in the feed direction than the upstream end portion, and the controlling of the printing portion includes controlling the printing portion so as to cause the printing on the print medium to be started when the processor has received the print data for printing.

4. The printer according to claim 1, wherein in a case where it is determined that the roll sheet is the outward facing roll sheet, the controlling of the printing portion includes controlling the printing portion so as to cause the printing on the print medium to be started when the processor has received print data for printing.

5. The printer according to claim 1, wherein in a case where it is determined that the roll sheet is the outward facing roll sheet, the computer-readable instructions further cause the printer to perform processes comprising:

controlling the feeding portion so as to cause the print medium leading end portion to be positioned further to the upstream side in the feed direction than the cutting position and further to the downstream side in the feed direction than the upstream end portion when the processor has received print data for printing, and the controlling of the printing portion includes controlling the printing portion so as to cause the printing on the print medium to be started after the controlling of the feeding portion is completed.

6. The printer according to claim 1, wherein in a case where it is determined that the roll sheet is the outward facing roll sheet, the computer-readable instructions further cause the printer to perform processes comprising:

controlling the feeding portion, after the print medium is cut by the cutting portion and before the processor receives print data for printing, so as to cause the print medium leading end portion to be positioned further to the upstream side in the feed direction than the cutting position and further to the downstream side in the feed direction than the upstream end portion, and the controlling of the printing portion includes controlling the printing portion so as to cause the printing on the print medium to be started when the processor has received the print data for printing.

7. The printer according to claim 1, further comprising:

a discharge outlet provided further to the downstream side in the feed direction than the cutting portion, and configured to discharge the print medium from a housing; wherein in a case where it is determined that the roll sheet is the outward facing roll sheet, the computer-readable instructions further cause the printer to perform processes comprising:

controlling the feeding portion, after the print medium is cut by the cutting portion and before the processor receives print data for printing, so as to cause the print medium leading end portion to be positioned at the discharge outlet, and the controlling of the printing portion includes controlling the printing portion so as to cause the printing on the print medium to be started when the processor has received the print data for printing.

8. The printer according to claim 1, further comprising:

a protruding portion provided between the printing portion and the guide portion; wherein the cutting portion is provided with a fixed blade and a movable blade, the movable blade being able to slide with respect to the fixed blade along a sliding direction that is orthogonal to the feed direction, the guide portion is an end surface of the fixed blade, the end surface facing the movable blade side in the sliding direction, and the protruding portion protrudes into a feed path of the print medium from the fixed blade side along the sliding direction.

* * * * *